US005970935A

United States Patent [19]

Harvey et al.

[11] Patent Number: 5,970,935

[45] Date of Patent: Oct. 26, 1999

[54] FUEL SYSTEM PRIMER BULB

[75] Inventors: Richard W. Harvey, Logansport; Steven P. Weaver, Royal Center, both of Ind.

[73] Assignee: Federal-Mogul World Wide, Inc., Southfield, Mich.

[21] Appl. No.: 09/146,156

[22] Filed: Sep. 3, 1998

[51] Int. Cl.[6] ..... F02M 37/16

[52] U.S. Cl. ..... 123/179.11

[58] Field of Search ..... 123/179.11; 261/DIG. 8

[56] References Cited

U.S. PATENT DOCUMENTS

| | | | |
|---|---|---|---|
| 1,064,055 | 6/1913 | Cuno | 123/179.11 |
| 1,327,430 | 1/1920 | Homold et al. | 123/179.11 |
| 2,730,093 | 1/1956 | Neely | 123/179.11 |
| 2,985,161 | 5/1961 | Seegrist | 123/179.11 |
| 3,177,920 | 4/1965 | Phillips | 123/179.11 |
| 3,233,652 | 2/1966 | Phillips | 123/179.11 |
| 3,371,658 | 3/1968 | Turner | 123/179.11 |
| 3,948,589 | 4/1976 | DuBois | 417/487 |
| 3,987,775 | 10/1976 | O'Connor | 123/179.11 |
| 4,466,412 | 8/1984 | McChesney | 123/492 |
| 4,497,290 | 2/1985 | Harris | 123/179.11 |
| 4,824,613 | 4/1989 | Scott et al. | 261/DIG. 8 |
| 4,893,594 | 1/1990 | Kobayashi | 123/179.9 |

*Primary Examiner*—Andrew M. Dollnar
*Attorney, Agent, or Firm*—Jon E. Shackelford

[57] ABSTRACT

The assembly comprises a flexible bulb 12 defining a pumping chamber 14 and secured at opposite ends by bands 34 to inlet and outlet housings 26. An inlet check valve 18 is supported by an inlet valve wall 38, which is, in turn, supported in a recess 36 in the inlet housing, to control fuel flow to the pumping chamber 14 while preventing reverse fuel flow out of the pumping chamber 14. An outlet check valve 22 is supported by an outlet valve wall 52 which is, in turn, supported in a recess 36 in the outlet housing for controlling fuel flow from the pumping chamber 14 while preventing reverse flow from the outlet housing into the pumping chamber 14. The assembly is characterized by a pressure relief valve, generally shown at 24, disposed between the inlet and the pumping chamber 14 for allowing fuel under a predetermined pressure in the pumping chamber 14 to reverse flow into the inlet. The opposite ends differ only by the inlet valve wall 38 supporting the relief valve 24.

14 Claims, 1 Drawing Sheet

FUEL SYSTEM PRIMER BULB

BACKGROUND OF THE INVENTION

1. Field of the Invention

This invention relates to a hand-held primer assembly for introducing starting fuel into the intake system of an internal combustion engine.

2. Description of the Prior Art

It is well known to use a flexible bulb with an inlet check valve and an outlet check valve to prime an internal combustion engine by manually squeezing the bulb to pump fuel into the engine and to suck fuel into the bulb as it is manually released. Because of the outlet check valve, the downstream pressure can become very high. Some new engines, which are fuel injected, include a vapor separator and float assembly, including a needle valve which is very light and relatively delicate. In fact, unduly high fuel pressure between the bulb and the float assembly could damage the needle valve.

In order to overcome such high pressure in the past, to prevent flooding of the engine, separate return systems have been combined with the flexible bulb, as disclosed in U.S. Pat. No. 3,233,652 to Phillips.

However, there remains a need for a system to relieve such high back pressure without the need of a separate return to prevent overcharging of the engine.

SUMMARY OF THE INVENTION AND ADVANTAGES

A hand-held primer assembly for introducing starting fuel into the intake system of an internal combustion engine. A flexible bulb defines a pumping chamber and an inlet supplies fuel to the pumping chamber and an outlet delivers fuel from the pumping chamber. An inlet check valve is in the inlet for supplying fuel to the pumping chamber while preventing reverse fuel flow out of the pumping chamber into the inlet. An outlet check valve is in the outlet for delivering fuel from the pumping chamber while preventing reverse flow from the outlet into the pumping chamber. The assembly is characterized by a pressure relief valve disposed between the inlet and the pumping chamber for allowing fuel under a predetermined pressure in the pumping chamber to reverse flow into the inlet.

Accordingly, this invention provides a compact flexible bulb assembly which is made of a minimum of universal components and which may be inserted into a fuel line to an internal combustion engine to prevent excessive back pressure without the need for a separate return system.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
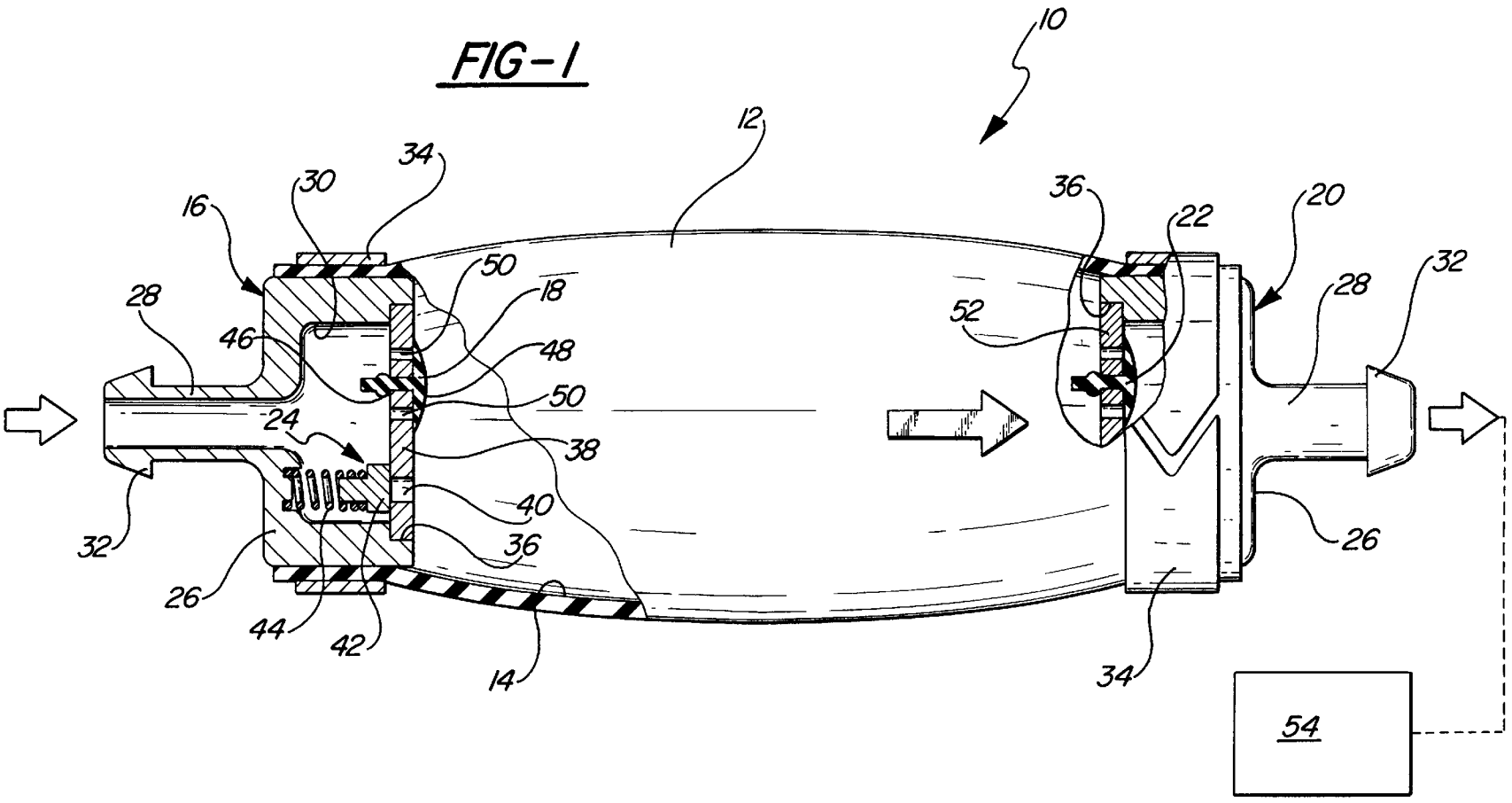
FIG. 1 is a side elevational view, partially broken away and in cross section.

Referring to the Figures, wherein like numerals indicate like or corresponding parts throughout the several views, a hand-held primer assembly for introducing starting fuel into the intake system of an internal combustion engine is generally shown at 10.

The assembly comprises a flexible bulb 12 which defines a pumping chamber 14. An inlet, generally indicated at 16, supplies fuel to the pumping chamber 14 and an inlet check valve 18 disposed in the inlet 16 controls fuel flow to the pumping chamber 14 while preventing reverse fuel flow out of the pumping chamber 14 and into the inlet 16. An outlet, generally indicated at 20, delivers fuel from the pumping chamber 14 to the intake system of an internal combustion engine. An outlet check valve 22 is disposed in the outlet 20 for controlling fuel flow from the pumping chamber 14 while preventing reverse flow from the outlet 20 into the pumping chamber 14.

The assembly is characterized by a pressure relief valve, generally shown at 24, disposed between the inlet 16 and the pumping chamber 14 for allowing fuel under a predetermined pressure in the pumping chamber 14 to reverse flow into the inlet 16.

The inlet 16 includes a circular inlet housing 26 presenting an inlet connector 28 and defining an inlet chamber 30. The inlet connector 28 comprises a tubular stem with an annular ridge 32 at the distal end for receiving a flexible fuel line for fluid communication with a source of fuel. The flexible bulb 12 is disposed in sealing engagement with the circular inlet housing 26 by a 34 encircling the housing 26 to clamp the flexible bulb 12 to the housing 26. The band 34 may be spring steel, plastic or a radiator type clamp. The housing 26 comprises a hard plastic material whereas the bulb is a rubber-like material sealed to the housing 26 by the clamp or ring 34.

The inlet housing 26 includes an annular recess 36 presenting a shoulder and an inlet valve wall 38 is retained in the recess 36 of the inlet housing 26 to extend across the inlet chamber 30 to divide the inlet chamber 30 from the pumping chamber 14 of the flexible bulb 12. The inlet valve wall 38 may be force fit or adhesively secured in the recess 36.

The inlet valve 18 and the relief valve 24 are both disposed in the inlet valve wall 38. The inlet valve wall 38 defines a hole 40 therein and the relief valve 24 comprises a poppet 42 normally covering the hole 40 and a spring 44 reacting between the poppet 42 and the inlet housing 26 to urge the poppet 42 to cover the hole 40 and movable to allow the poppet 42 to uncover the hole 40 in response to the predetermined back pressure in the pumping chamber 14.

The inlet valve 18 is an umbrella valve having a stem 46 retained in the inlet valve wall 38 and a circular dome 48 overlying apertures 50 in the inlet valve wall 38. The dome 48 of the inlet valve is disposed inside the pumping chamber 14 of the bulb 12.

The outlet 20 is identical to the inlet 16 and includes an outlet housing 26 presenting an outlet connector 28 in fluid communication with the intake system of an internal combustion engine 54, i.e., a needle valve of a float assembly in a fuel injected engine 54. The flexible bulb 12 is also disposed in sealing engagement with the outlet housing 26 by a band 34. The outlet 20 defines an outlet chamber and includes an annular recess 36 presenting a shoulder and an outlet valve wall 52 is retained in the recess 36 of the outlet housing 26 to extend across the outlet chamber to divide the outlet chamber from the pumping chamber 14 of the flexible bulb 12. The outlet valve 22 is disposed in the outlet valve wall 52. The outlet valve 22 is identical to the inlet valve 18 except the dome 48 of the outlet valve 22 is disposed outside of the pumping chamber 14 of the bulb 12.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A hand-held primer assembly for introducing starting fuel into the intake system of an internal combustion engine, said assembly comprising;

a flexible bulb (12) defining a pumping chamber (14), an inlet (16) for supplying fuel to said pumping chamber (14), an inlet check valve (18) in said inlet (16) for controlling fuel flow to said pumping chamber (14) while preventing reverse fuel flow out of said pumping chamber (14) into said inlet (16), an outlet (20) for delivering fuel from said pumping chamber (14), an outlet check valve (22) in said outlet (20) for controlling fuel flow from said pumping chamber (14) while preventing reverse flow from said outlet (20) into said pumping chamber (14), said assembly characterized by a pressure relief valve (24) disposed between said inlet (16) and said pumping chamber (14) for allowing fuel under a predetermined pressure in said pumping chamber (14) to reverse flow into said inlet (16).

2. An assembly as set forth in claim 1 wherein said inlet (16) includes an inlet housing (26) presenting an inlet connector (28) for fluid communication with a source of fuel and an inlet chamber (30), said flexible bulb (12) disposed in sealing engagement with said inlet housing.

3. An assembly as set forth in claim 2 including an inlet valve wall (38) extending across said inlet chamber (30) to divide said inlet chamber (30) from said pumping chamber (14) of said flexible bulb (12).

4. An assembly as set forth in claim 3 wherein said inlet valve and said relief valve are disposed in said inlet valve wall (38).

5. An assembly as set forth in claim 4 wherein inlet valve wall (38) defines a hole (40) therein and said relief valve comprises a poppet (42) normally covering said hole (40) and a spring (44) reacting between said poppet (42) and said inlet housing (26) to urge said poppet (42) to cover said hole (40) and movable to allow said poppet (42) to uncover said hole (40) in response to said predetermined pressure.

6. An assembly as set forth in claim 5 wherein said outlet (20) includes an outlet housing (26) presenting an outlet connector (28) for fluid communication with the intake system (46) of an internal combustion engine and defining an outlet chamber, said flexible bulb (12) disposed in sealing engagement with said outlet housing (26).

7. An assembly as set forth in claim 6 including an outlet valve wall extending across said outlet chamber to divide said outlet chamber from said pumping chamber (14) of said flexible bulb (12).

8. An assembly as set forth in claim 7 wherein said outlet valve is disposed in said outlet valve wall.

9. An assembly as set forth in claim 8 wherein said inlet and outlet valves are umbrella valves having a stem (46) retained in said associated valve wall and a circular dome (48) overlying apertures (50) in said associated valve wall, said dome (48) of said inlet valve being disposed inside said pumping chamber (14) of said bulb (12) and said dome (48) of said outlet valve being disposed outside of said pumping chamber (14) of said bulb (12).

10. An assembly as set forth in claim 6 wherein said housings are circular in cross section and including a band (34) encircling each of said housings to clamp said flexible bulb (12) to said respective housings.

11. An assembly as set forth in claim 6 wherein each of said connectors comprises a tubular stem (46) for receiving a fuel line.

12. An assembly as set forth in claim 6 wherein said housings comprise hard plastic material.

13. An assembly as set forth in claim 6 wherein each of said housings includes an annular recess (36) and said inlet valve wall (38) is retained in said recess (36) of said inlet housing (26) and said outlet valve wall is retained in said recess (36) of said outlet housing (26).

14. A primer assembly for introducing starting fuel into the intake system of an internal combustion engine, said assembly comprising;

a needle valve of in a float assembly in a fuel injected engine (54), a flexible bulb (12) defining a pumping chamber (14), an inlet (16) for supplying fuel to said pumping chamber (14), an inlet check valve (18) in said inlet (16) for controlling fuel flow to said pumping chamber (14) while preventing reverse fuel flow out of said pumping chamber (14) into said inlet (16), an outlet (20) in fluid communication with the needle valve for delivering fuel from said pumping chamber (14) to said fuel injected engine (54), an outlet check valve (22) in said outlet (20) for controlling fuel flow from said pumping chamber (14) while preventing reverse flow from said outlet (20) into said pumping chamber (14), said assembly characterized by a pressure relief valve (24) disposed between said inlet (16) and said pumping chamber (14) for allowing fuel under a predetermined pressure in said pumping chamber (14) to reverse flow into said inlet (16).

* * * * *